US007992306B2

(12) United States Patent
Standiford

(10) Patent No.: US 7,992,306 B2
(45) Date of Patent: Aug. 9, 2011

(54) HEATED LINE CUTTER AND WHIPPER

(76) Inventor: Willard E. Standiford, Baltimore, MD (US)

( * ) Notice: Subject to any disclaimer, the term of this patent is extended or adjusted under 35 U.S.C. 154(b) by 546 days.

(21) Appl. No.: 12/156,992

(22) Filed: Jun. 6, 2008

(65) Prior Publication Data

US 2008/0235952 A1 Oct. 2, 2008

Related U.S. Application Data

(63) Continuation-in-part of application No. 11/450,055, filed on Jun. 9, 2006, now abandoned.

(51) Int. Cl.
*B26B 13/00* (2006.01)

(52) U.S. Cl. ..... 30/140; 30/92

(58) Field of Classification Search ..... 30/140, 30/92; 264/163–168; 425/294–311, 318
See application file for complete search history.

(56) References Cited

U.S. PATENT DOCUMENTS

| | | | | | |
|---|---|---|---|---|---|
| 2,032,688 | A * | 3/1936 | Dart | 30/140 |
| 2,884,708 | A * | 5/1959 | Levitt | 34/553 |
| 4,046,148 | A * | 9/1977 | Meador | 30/140 |
| 4,336,652 | A * | 6/1982 | Robertson | 30/92 |
| 4,349,966 | A * | 9/1982 | Marino et al. | 30/289 |
| 4,516,574 | A * | 5/1985 | Hewes, Jr. | 30/140 |
| 4,587,968 | A * | 5/1986 | Price | 30/140 |
| 5,300,083 | A * | 4/1994 | Lin et al. | 30/140 |
| 5,472,654 | A * | 12/1995 | Crawford | 264/163 |
| 6,061,912 | A * | 5/2000 | Gazaway | 30/140 |
| 6,499,952 | B1 * | 12/2002 | Jacot et al. | 416/155 |
| 6,640,441 | B1 * | 11/2003 | Huang | 30/233 |
| D558,553 | S * | 1/2008 | Feith | D8/98 |

* cited by examiner

*Primary Examiner* — Stephen Choi
(74) *Attorney, Agent, or Firm* — William S. Ramsey

(57) ABSTRACT

An exemplary embodiment includes a heated blade for cutting a synthetic line or rope as well as heated sealing cylinders for sealing the cut or raw ends against raveling. The cutter can accommodate lines of a variety of diameters. The cutter is powered by a rechargeable battery and is portable and safe for use in a marine environment. Other embodiments seal the raw ends by shrinking a heat-shrinkable tubing over the raw ends.

18 Claims, 9 Drawing Sheets

HEATED LINE CUTTER AND WHIPPER

CROSS-REFERENCE(S)

This application is a continuation in part of Ser. No. 11/450,055, filed Jun. 9, 2006, which claims priority from provisional application Ser. No. 60/727,778, filed Oct. 18, 2005.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND

Description of Related Art Including Information Disclosed Under 37 CFR 1.97 and 37 CFR 1.98

Lines or ropes are widely used in the marine environment, for outdoor climbing, and in construction work. Virtually all lines used today are manufactured of synthetic polymers, such as nylon or polypropylene. Such lines often are complex in structure. They may involve a 3-strand twist construction or are braided. A number of different braids are in use, such as solid braid, hollow braid, also known as single braid, plait, double braid, and diamond braid. Braided lines may be single-braided and constructed of a single polymer or double-braided in which a braided core is covered by a braided sheath. The core and sheath may be of the same or different materials. The core may be constructed of several different materials.

No matter the construction, cutting a line produces two raw ends which must be treated to prevent raveling or unraveling, a process termed "whipping." A conventional whipping process involves wrapping the cut end with thread or twine. A common whipping process today involves melting the synthetic polymers at the cut ends to prevent raveling.

Another contemplated application involves the use of the apparatus to heat shrink shrinkable tubing and heat shrinkable tape about the ends of cables and electrical wires by cable splicers, electricians, and linesmen.

U.S. Pat. No. 1,947,857 discloses a plug-in electrically heated knife for bee keepers or bakers. The blade is heated by an insulated resistance element located in a metal housing welded to the blade.

U.S. Pat. No. 3,024,342 discloses a knife with a pivoting blade, in which an electrical circuit is completed when the knife is pressed against the work being cut. The cutting edge is heated by a heating element in close contact with two sides of the blade and which is covered by a heat-resistant housing.

U.S. Pat. No. 3,952,376 discloses an apparatus for secuting two elongated members using a friction member between the elongated members and a heat shrinkable tube.

U.S. Pat. No. 4,622,966 discloses a scalpel blade in which the steel cutting edge is heated by electrical resistant heater means which transfers heat via a copper laminate.

U.S. Pat. No. 5,472,654 discloses a portable device which cuts synthetic materials including rope and singes the cut surface with a flame in order to prevent unraveling. The flame is provided by a flammable fluid burner.

U.S. Pat. No. 5,611,798 discloses a heated cutting and coagulating instrument in which a U-shaped support is electrically heated by a resistance element and supports a cutting edge.

U.S. Pat. No. 6,012,912 discloses an instrument for cutting multi-strand plastic fiber materials using heat from heating elements or an outside source to cut and simultaneously cauterize the cut ends.

U.S. Pat. No. 6,235,027 discloses a forceps in which silicon nitrade ceramic heaters are attached to the tines and are heated by current from a battery.

Pub. US Pat. Applic. No. 2001/0027968 discloses a folding cauterizing knife in which battery power is used to heat the blade when the blade is extended and a switch is activated. Cutting is achieved by a metallic cautery filament installed in a ceramic or metallic blade.

German Pub. Pat. Applic. No. DE 3838893 A1 discloses securing rope ends from untwisting using a heat-shrinkable plastic tube.

Hot Knife [online], [retrieved on 2005-09-22]. Retrieved from the Internet <URL: www.westmarine.com>, discloses a line cutter with a heated blade in which the power source is plugged into a wall socket.

The foregoing examples of the related art and limitations related therewith are intended to be illustrative and not exclusive. Other limitations of the related art will become apparent to those of skill in the art upon a reading of the specification and a study of the drawings.

The discovered examples of the related art do not provide the advantages of the present embodiments, that is, to provide a portable line cutter which efficiently and effectively cuts synthetic lines and sequentially seals or whips the raw ends against raveling.

BRIEF SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

Embodiments include a heated line cutter and whipper comprising an upper arm mounted by a pivot to a lower arm, each arm supporting two gutter-shaped troughs, the troughs mounted approximately perpendicular to the arms, the troughs comprised of material capable of resistance heating when in an electrical circuit, the troughs on one arm capable of interacting with troughs on the other arm and enclosing a line to be cut, and the troughs separated by a slot. Some embodiments include only a single trough. Troughs have been constructed of anodized aluminum and wrapped with NICHROME wire. There also is a cutting arm having a handle and a blade, the blade comprised of material capable of resistance heating when in an electrical circuit, the cutting arm mounted by a pivot to one arm, and the blade capable of passing through the slot and cutting a line. Further elements include an electrical source and wires, and switches for placing the troughs and blade in electrical circuits.

In addition to the exemplary aspects and embodiments described above, further aspects and embodiments will become apparent by reference to the drawings and by study of the following descriptions.

DETAILED DESCRIPTION

Figure 1:
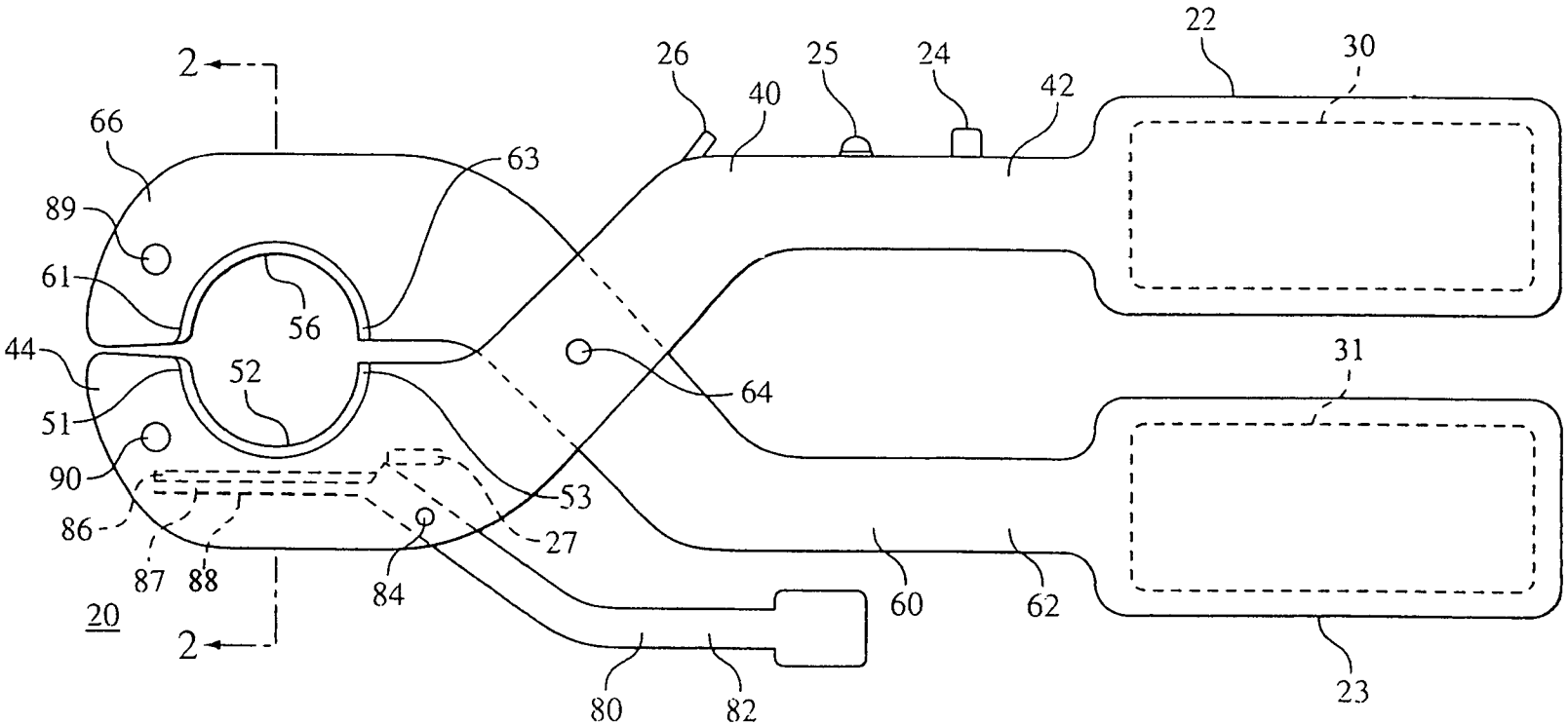
FIG. 1 is a plan view of a first embodiment heated line cutter and whipper.

FIG. 1 is a plan view of a first embodiment heated line cutter and whipper 20. Visible in FIG. 1 is the lower arm 40 comprised of a lower arm handle 42 and a lower arm trough support 44. Also visible in FIG. 1 and attached to the lower arm handle 42 are a rechargeable battery container 22 which holds one or more rechargeable batteries 30, a general off/on switch 24, an off/on indicator light 25 and a normally-off spring switch 26 which controls the heating of the troughs. Normally-off spring switch 27, shown in dashed lines, controls the heating of the knife. The general off/on switch 24 controls the electricity to all the troughs and the knife. The lower arm trough support 44 is pierced by the lower arm knife slot 46 (not visible in FIG. 1). Troughs are gutter-shaped structures the left lower trough 52 extends across the lower arm trough support 44 approximately perpendicular to the knife slot 46 (not visible in FIG. 1), and interrupted by the knife slot, dividing each trough into a left trough and a right trough. The troughs are comprised of material capable of resistance heating when in an electrical circuit. Lower arm rest posts 90 project approximately 1 inch from the left and right sides of the lower arm trough support 44. The arm rest posts are constructed of heat resistant material and allow a hot cutter and whipper to be placed on a surface without fear of burning or damaging the surface.

Also visible in FIG. 1 is the upper arm 60 comprised of an upper arm handle 62 and upper arm trough support 66. A battery container 23 which holds one or more rechargeable batteries 31, is at the end of the upper arm handle. The upper arm trough support 66 is pierced by the upper arm knife slot 68 (not visible in FIG. 1). Troughs are gutter-shaped structures extending across the upper arm trough support 66 approximately perpendicular to the knife slot 68 (not visible in FIG. 1), and interrupted by the knife slot, dividing each trough into a left trough and a right trough. The troughs are comprised of material capable of resistance heating when in an electrical circuit. The upper arm and lower arm are pivotally connected by a bolt 64. Upper arm rest posts 89 project approximately 1 inch from the left and right sides of the upper arm trough support 66. The arm rest post are constructed of heat resistant material and allows a hot cutter and whipper to be placed on a surface without fear of burning or damaging the surface.

Also visible in FIG. 1 is a cutter arm 80, comprised of a cutter handle 82 and a blade support 88. A blade 86 extends along and is attached to the upper edge 87 of the blade support 88. The blade is comprised of material capable of resistance heating when in an electrical circuit. The cutter arm 80 is pivotally connected to the lower arm trough support 44 by bolt 84.

In describing the elements of the embodiments heated cutter and whipper, the term "distal" refers to elements located on the arms more distant from the battery and the term "proximal" refers to elements located closer to the battery. The term "ventral" refers to elements located on the arms on the same side as the surface of the troughs in contact with the line being cut or whipped, and the term "dorsal refers to elements located on the side of the arm more distant from the surface of the troughs in contact with the line being cut or whipped.

Figure 2:
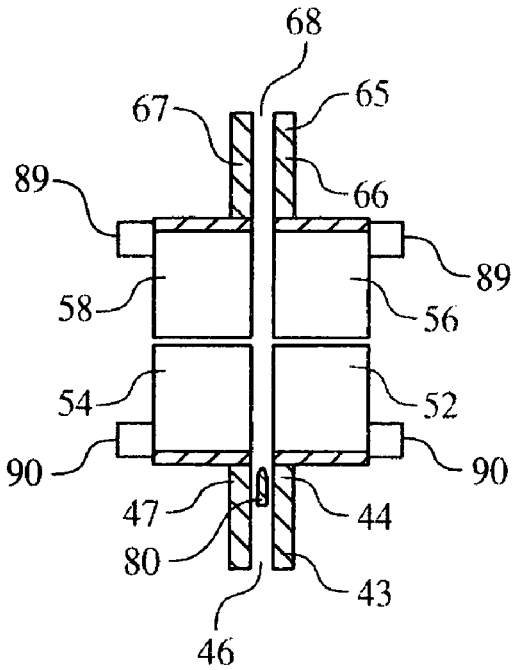
FIG. 2 is a cross-sectional view taken at line 2-2 of FIG. 1.

FIG. 2 is a cross-sectional view taken at line 2-2 of FIG. 1. Visible in FIG. 2 is the lower arm left trough 52, the lower arm right trough 54, the upper arm left trough 56, and the upper arm right trough 58. Slot 46 extends between the left leg 43 and the right leg 47 of the lower arm trough support 44. Slot 68 extends between the left leg 65 and the right leg 67 of the upper arm trough support 66. The lower arm rest posts 90 (not visible in FIG. 2) extend from the left leg 43 and the right leg 47 of the lower arm trough support 44. The upper arm rest posts 89 (not visible in FIG. 2) extend from the left leg 65 and the right leg 67 of the upper arm trough support 66.

Figure 3:
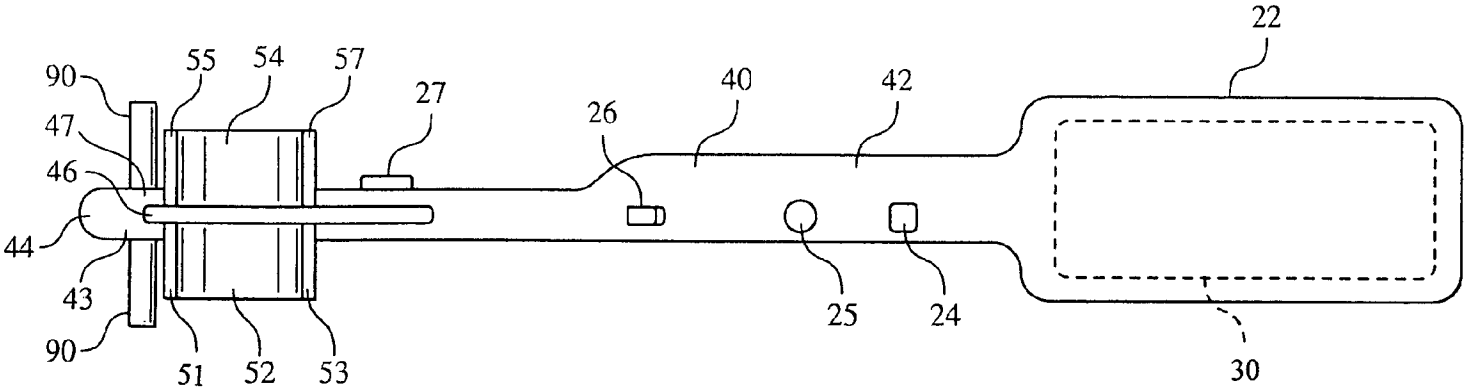
FIG. 3 is a ventral view of the lower arm of the first embodiment heated line cutter and whipper.

FIG. 3 is a ventral view of the lower arm 40 of the first embodiment heated line cutter and whipper showing the lower arm handle 42 and lower arm trough support 44 which is comprised of the left leg 43 and right leg 47 which are separated by slot 46. Also shown is the left lower trough 52 and right lower trough 54 attached to and supported by the left leg 43 and right leg 47, respectively. Electrically conductive contacts 51 and 55 extends along the distal edge of the left lower trough 52 and right lower trough 54, respectively. Electrically conductive contacts 53 and 57 extend from the proximal edge of the left lower through 52 and right lower trough 54, respectively.

Also visible in FIG. 3 are a rechargeable battery container 22 containing one or more rechargeable batteries 30, general off/on switch 24, off/on indicator light 25, normally-off spring switch 26. The general off/on switch 24 controls the flow of electricity to the troughs and to the knife. The normally-off spring switch 26 controls the flow of electricity to the troughs. The normally-off spring switch 27 controls the flow of electricity to the knife. The indicator light 25, is illuminated when the general off/on switch is in the on position. Lower arm post 90 is visible.

Figure 4:
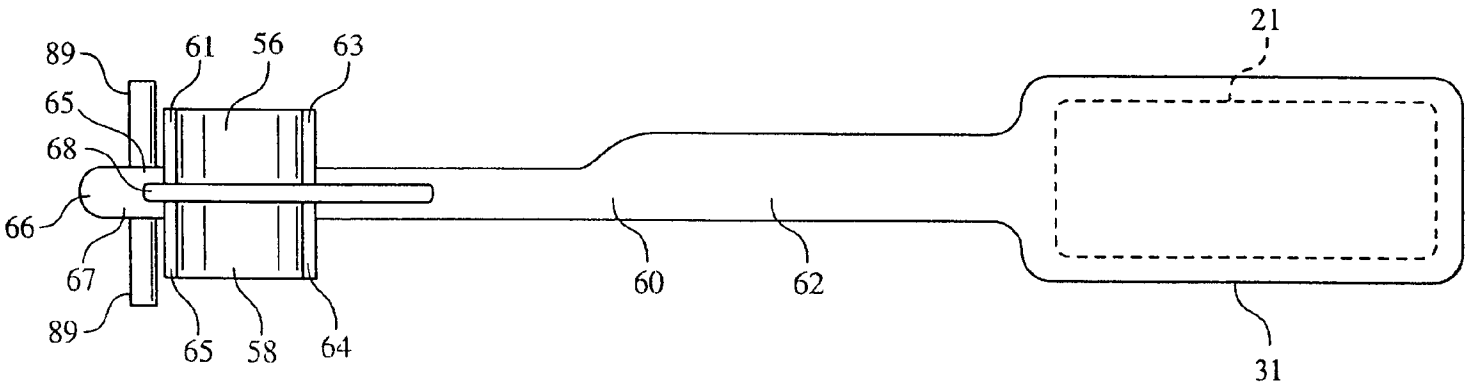
FIG. 4 is a ventral view of the upper arm of the first embodiment heated line cutter and whipper.

FIG. 4 is a ventral view of the upper arm 60 of the first embodiment heated line cutter and whipper with first embodiment troughs showing the upper arm handle 62, the upper arm battery container 21 containing one or more rechargeable batteries 31, and upper arm trough support 66 which is comprised of the right leg 67 and left leg 65 which are separated by slot 68. Also shown is the right upper trough 58 and left upper trough 56 attached to and supported by the right leg 67 and left leg 65, respectively. Electrically conductive contacts at 69 and 61 extends along the distal edge of the right upper trough 58 and left upper trough 56, respectively and conductive contacts at 64 and 63 extend along the proximal edge of the right upper trough 58 and left upper trough 56, respectively. Upper arm post 89 is visible.

Figure 5:
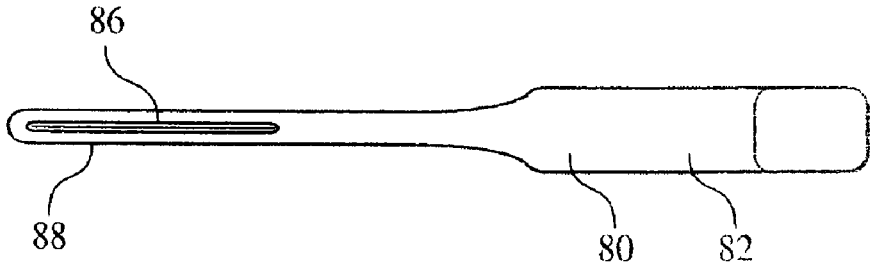
FIG. 5 is a ventral view of the cutter arm of the first embodiment heated line cutter and whipper.

FIG. 5 is a ventral view of the cutter arm 80 of the first embodiment heated line cutter and whipper. Visible in FIG. 5 is the cutter arm handle 82, blade support 88 and cutter blade 86. The blade is comprised of material capable of resistance heating when in an electrical circuit. The cutter arm 80 is pivotally connected to the lower arm trough support 44 by a bolt 84 (visible in FIG. 1).

In use, a line to be cut and whipped is grasped by the troughs 52, 54, 56, and 58 by the operator who grasps the arm handles 42 and 62 and moves the handles toward each other. The operator then moves the cutter blade handle 82 away from the upper arm handle 62. This movement activates a normally-off spring switch 27 which sends electrical current to the cutter blade, thereby heating the blade. The heated blade is moved against the line, severing the line. Movement of the cutter blade handle 82 toward the upper arm handle 62 releases the normally-off spring switch 27 and turns off the current to the cutter blade. Normally-off spring switch 26 is then depressed by the operator causing the troughs to be heated and whipping the ends of the cut line through the heating effect of the troughs on the cut ends. The handles then are moved apart, releasing the whipped ends of the line.

Figure 6:
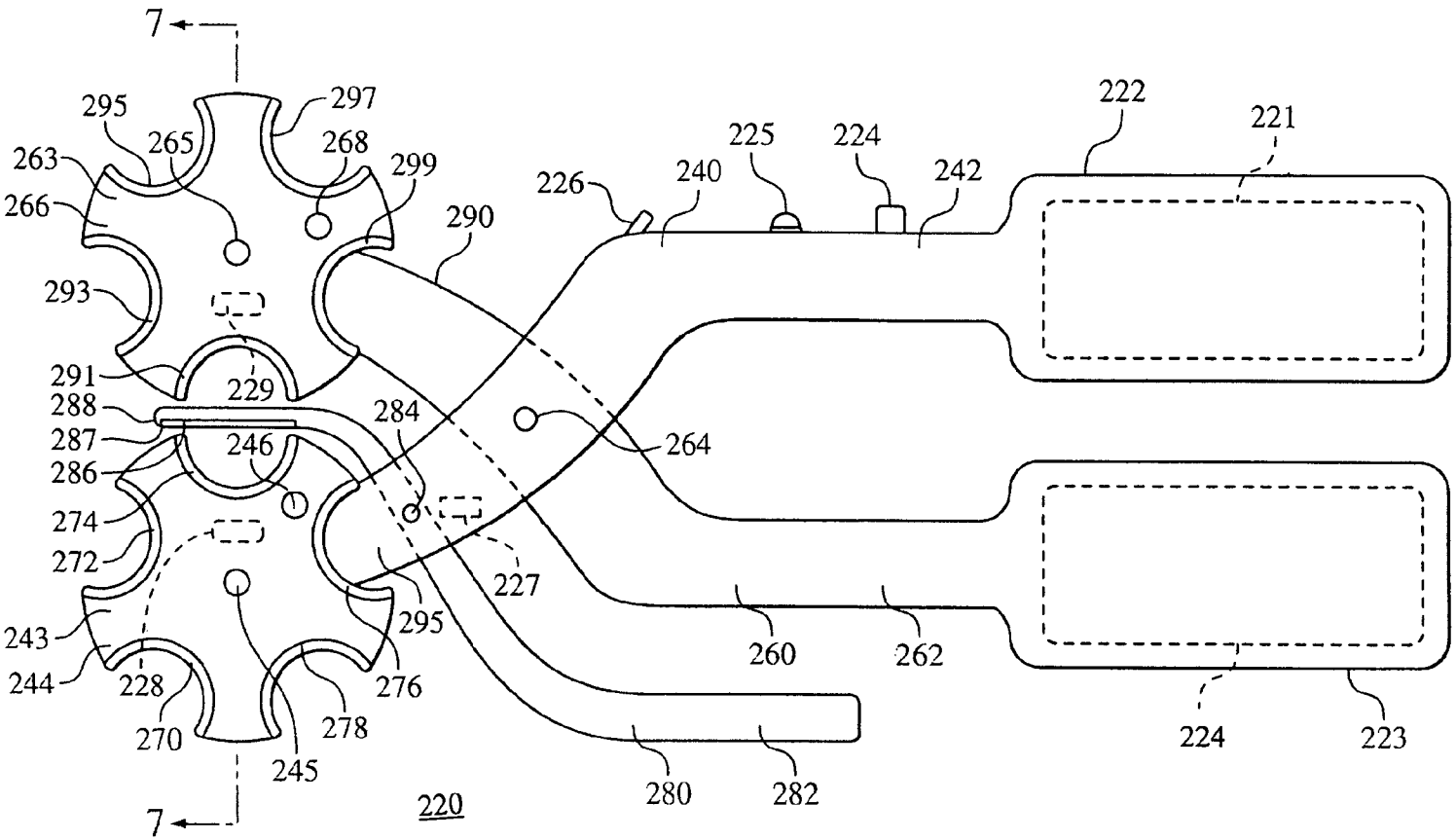
FIG. 6 is a plan view of the second embodiment heated line cutter and whipper.

FIG. 6 is a plan view of a second embodiment 220 heated line cutter and whipper. The second embodiment differs from the first embodiment primarily in the provision in the second embodiment of upper and lower arm cylinders which have mounted on the circumferences a number of different sized troughs. Orientation of corresponding troughs allow the use of the second embodiment heated cutter and whipper to cut and whip a variety of different diameter lines.

FIG. 6 is a plan view of a second embodiment heated line cutter and whipper 30. Visible in FIG. 6 is the lower arm 240 comprised of a lower arm handle 242, lower arm trough support 300, and a lower arm trough support cylinder 244. Also visible in FIG. 6 and attached to the lower arm handle 242 are rechargeable battery container 222, one or more rechargeable batteries 221, a general off/on switch 224, an off/on indicator light 225 and a normally-off spring switch 226 which controls the heating of the troughs which are in the cutting position. The general off/on switch 224 controls the electricity to the troughs and the knife. The lower arm trough support cylinder 244 is comprised of the circular lower left disk 243 which is fixedly connected to a circular lower right disk 241 (not visible in FIG. 6) by the lower cylinder axle 245. The lower cylinder axle 245 passes through a hole in the lower arm trough support 300. A number of troughs of varying diameter, 270, 272, 274, 276, and 278 are arrayed about the circumference of the lower left disk 243. The upper and lower disks are rotated to bring troughs of the same size into an adjacent relationship in the cutting position. Electrical contacts leading to each trough make contact with rotating contact 228 located on the lower arm trough support 295 when the troughs are in cutting position.

Lower arm rest posts 246 and 247 project approximately 1 inch from the left 243 and right 241 disks of the lower arm trough support cylinder 244, respectively. The arm rest posts are constructed of heat resistant material and allow a hot cutter and whipper to be placed on a surface without fear of burning or damaging the surface. They also can be used as handles in rotating the lower arm trough support cylinder 244.

Also visible in FIG. 6 is the upper arm 260 comprised of an upper arm handle 262, upper arm trough support 290, and upper arm trough support cylinder 266. A rechargeable battery container 223 containing a rechargeable battery 230 is at the end of the upper arm handle. The upper arm trough support cylinder 266 is comprised of the upper left disk 263 which is fixedly connected to an upper right disk 264 (not visible in FIG. 6) by the upper cylinder axle 265. The upper cylinder axle passes through a hole in the upper arm trough support 290. A number of troughs of varying diameter, 295, 293, 291, 299, and 297 are arrayed about the circumference of the upper left disk 263. The upper and lower disks are rotated to bring troughs of the same size in adjacent relationship in the cutting position near the cutting blade. Electrical contacts leading to each trough make contact with rotating contact 229 in the upper arm trough support 290 when the troughs are in the cutting position.

Upper arm rest post 268 and 267 project approximately 1 inch from the left 263 and right 264 disks of the upper arm trough support cylinder 266, respectively. The arm rest posts are constructed of heat resistant material and allow a hot cutter and whipper to be placed on a surface without fear of burning or damaging the surface. They also can be used as handles in rotating the upper arm trough support cylinder 266.

The upper arm trough support 266 is pierced by the upper arm knife slot 262 (not visible in FIG. 6). Troughs are gutter-shaped structures extending across the upper arm trough support 266 approximately perpendicular to the knife slot 268 (not visible in FIG. 6), and interrupted by the knife slot, dividing each trough into a left trough and a right trough. The troughs are comprised of material capable of resistance heating when in an electrical circuit. The upper arm and lower arm are pivotally connected by a bolt 264. Upper arm rest posts 268 project approximately 1 inch from the left and right sides of the upper arm trough support 266.

In use, a line to be cut and whipped is grasped by the troughs, for example, 275, 274, 291, and 292 (shown in FIG. 7) by the operator who grasps the arm handles 242 and 262 (shown in FIG. 6) and moves the handles toward each others. Movement of the cutter handle 282 toward handle 262 depresses the normally-off spring switch 227 (shown in dashed line in FIG. 6) and causes electrical current to be switched to the cutter blade 286 which is then heated. After the line is cut, movement of the cutter blade to the non-cutting position releases the normally-off spring switch 227 and causes the electrical current to the blade to be switched off. Normally-off spring switch 226 is then engaged and causes electrical current to be switched to those troughs which are in the cutting position, in this example 275, 274, 291, and 292. After the line ends are whipped, the electrical current to the troughs is switched off by releasing normally-off spring switch 226. The handles are then moved apart, releasing the whipped ends of the cut line.

Alternatively, the ends of a cut line may be wrapped with plastic tape or enclosed in heat shrink tubing, engulfed by the troughs, and heated by the troughs. Heating will cause plastic tape and heat shrink tubing to shrink, thereby whipping the ends. In addition, a line to be cut may be wrapped with plastic tape, and cut through the tape, then heated with the troughs. This also causes the tape to shrink, whipping the ends of the line.

Also visible in FIG. 6 is a cutter arm 280, comprised of a cutter handle 282 and a blade support 288. A blade 286 extends along and is attached to the ventral edge 287 of the blade support 288. The blade is comprised of material capable of resistance heating when in an electrical circuit. The cutter arm 280 is pivotally connected to the lower arm 240 by bolt 284.

Figure 7:
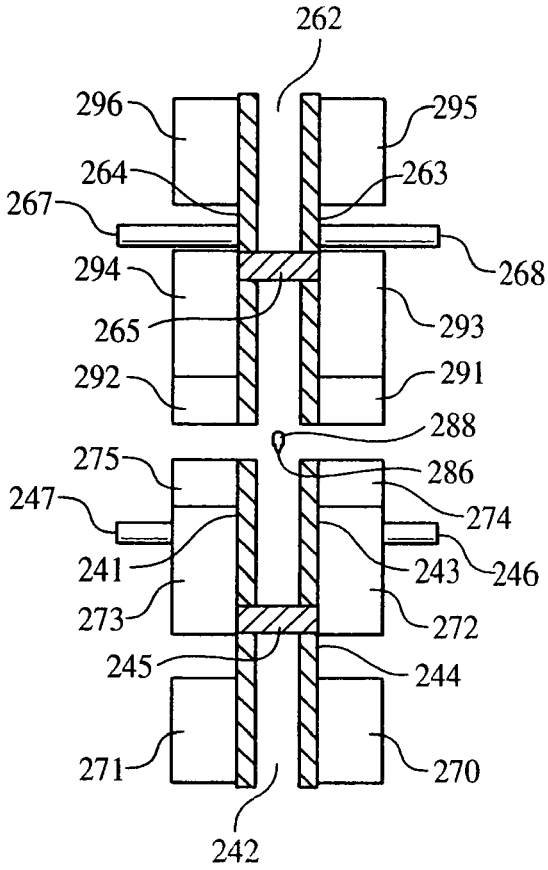
FIG. 7 is a cross-section view of the second embodiment heated line cutter and whipper taken along line 7-7 of FIG. 6.

FIG. 7 is a cross-section view of the second embodiment heated line cutter and whipper taken along line 7-7 of FIG. 6.

Visible in FIG. 7 is the lower arm trough support cylinder 244 comprised of lower left disk 243 fixedly attached to lower right disk 241 by lower cylinder axle 245. Also visible are left 274 and right 275 troughs which have similar diameters, left 272 and right 273 troughs which have similar diameters, and left 270 and right 271 troughs which have similar diameters. Also visible are left disk rest post 246 attached to the lower left disk 243 and the right disk rest post 247 attached to the lower right disk 241. The lower knife slot 242 is visible between the lower left disk 243 and the lower right disk 241.

Also visible in FIG. 7 is the upper arm trough support cylinder 266 comprised of upper left disk 263 fixedly attached to upper right disk 264 by upper cylinder axle 265. Also visible are left 295 and right 296 troughs which have similar diameters, left 293 and right 294 troughs which have similar diameters, and left 291 and right 292 troughs which have similar diameters. Also visible are left disk rest post 268 attached to the upper left disk 263 and the right disk rest post 267 attached to the upper right disk 264. The upper knife slot 262 is visible between the upper left disk 263 and the upper right disk 264.

Also visible in FIG. 7 is the blade support 288 and the blade 286. In this FIG. 7 example of the second embodiment heated cutter and whipper the upper and lower arm cylinders 266 and 244 are oriented so that similar sized troughs are opposed, in this example similar diameter lower troughs 274 and 275 and similar diameter upper troughs 291 and 292. The handle of the upper arm 242 and the handle of the lower arm 262 are grasped by the operator and moved together, thereby enclosing the line to be cut and whipped in the troughs 274, 275, 291 and 292. The troughs and blade are electrically heated. The cutter handle 282 is grasped by the operator and moved toward the handle of the upper arm 262. Movement of the cutter handle cause the movement of the cutter blade support 288 and heated blade 286 through the line, thereby sequentially severing the line and whipping the ends through the heating effect of the troughs on the cut ends.

Figure 8:
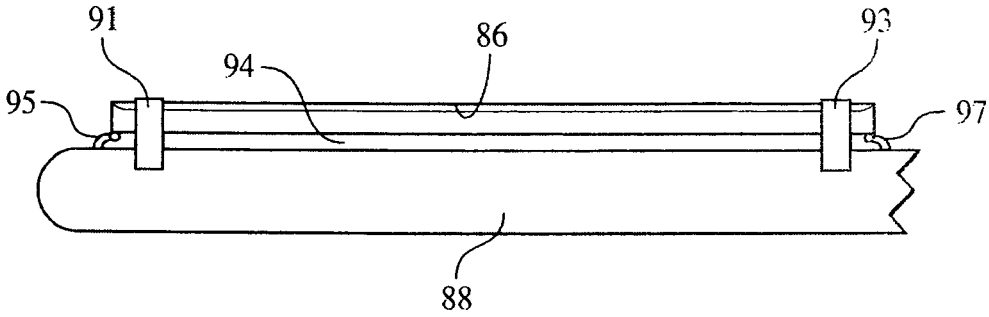
FIG. 8 is a plan view of one embodiment knife blade.

FIG. 8 is a plan view of one embodiment knife blade. Visible in FIG. 8 is the blade support 88, blade 86, distal blade attachment 91, proximal blade attachment 93, distal blade electrical connection 95 and proximal blade electrical connection 97. The blade is separated from the blade support 88 by a gap 94.

In one embodiment, the blade 86 is comprised of a NICHROME ribbon, preferably but not limited to 0.24×0.138 inch. NICHROME is a trademark for resistance-wire and ribbon owned by Driver-Harris Company Corporation, Harrison, N.J. Any suitable resistance wire or ribbon may be used in embodiments. The distal and proximal blade attachments 91 and 93, respectively, rigidly attach the blade to the blade support 88 and support the blade against bending, and are comprised of stainless steel or other suitable material. One end of the attachments is embedded in the blade support and the blade is welded to the blade attachments, although one of ordinary skill would understand that other configurations are possible. The distal and proximal blade electrical connections, 95 and 97, respectively, provide electrical current to the knife blade for heating the blade.

In other knife blade embodiments #16 agw NICHROME wire or other resistance wire is used as a knife blade. The wire blade can be attached to the blade support as in the above embodiment. Alternatively a NICHROME ribbon is used as the knife blade. The ribbon can be attached to a blade support or can be used as a self-supporting knife blade.

Figure 9:
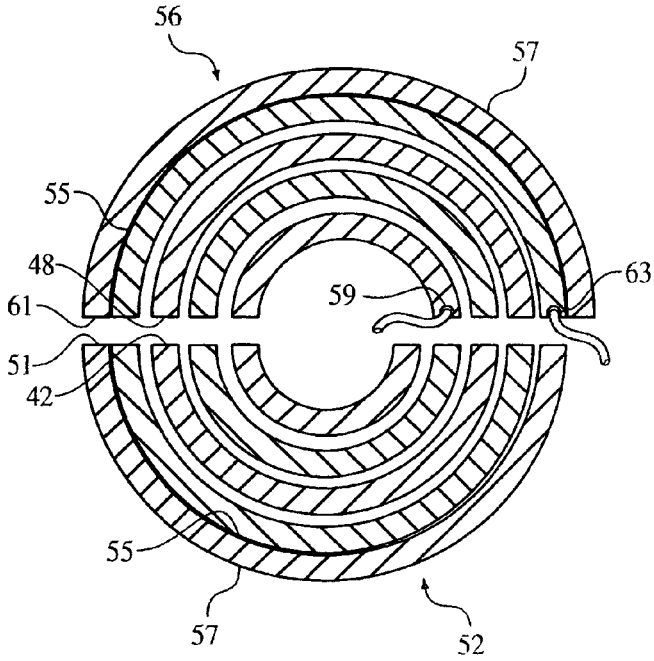
FIG. 9 is a perspective view of a first embodiment trough.

FIG. 9 is a perspective view of two examples of a first embodiment trough. This embodiment 52 and 56 can be thought of as a spiral of NICHROME wire or other resistance wire 55 embedded in a coating of SAUREISEN INSULTEMP CEMENT NO. 10 resin 57 or other suitable resin. SAUREISEN INSULTEMP CEMENT NO. 10 is a trademark for phosphate-bonded and alumina-filled material that cures by a chemical-set owned by Sauereisen Cements Company, Pittsburgh, Pa. Any suitable resin which is strong and heat resistant can be used. The cylinder containing embedded NICHROME wire is then cut along a diameter, providing an upper 56 and lower 52 trough. The corresponding ends of the NICHROME wires in the upper 56 and lower 52 troughs are in electrical contact, for example, at ends 51 and 61; and at ends 42 and 48. Left electrical contact 63 and right electrical contact 59 provide electrical current to the troughs for heating the troughs. The current spirals through the length of the troughs, thereby heating the troughs. Alternatively the troughs can be made of anodized aluminum wrapped with NICHROME ribbon. Anodized aluminum has the properties of good heat transfer and resistance to salt water corrosion.

Figure 10:
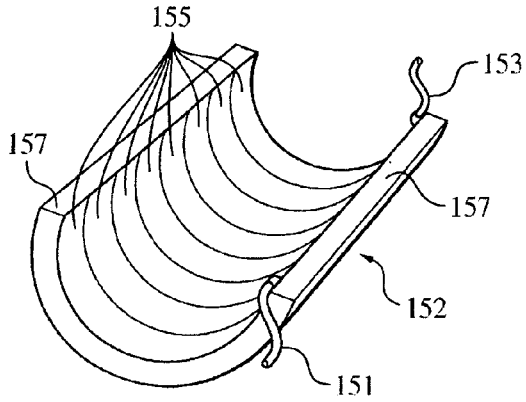
FIG. 10 is a perspective view of a second embodiment trough.

FIG. 10 is a perspective view of a second embodiment trough 152. In this embodiment hemispherical lengths of NICHROME ribbon 155 or other suitable resistance ribbon are mounted with SAUREISEN INSULTEMP CEMENT No. 10 resin or other suitable resin on a hemispheric length of that resin 157. The lengths of ribbon 155 are in lateral electrical contact. Left electrical connector 151 and right electrical connector 153 provide electrical current to the trough for the heating of the trough.

Figure 11:
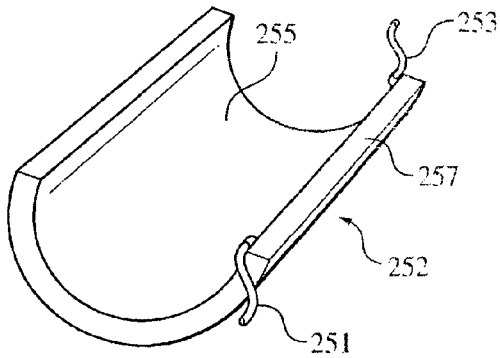
FIG. 11 is a perspective view of a third embodiment trough.

FIG. 11 is perspective view of a third embodiment trough 252. In this embodiment a single length of NICHROME or other resistant material ribbon 255 is mounted on a hemispheric length of SAUREISEN INSULTEMP CEMENT NO. 10 resin or other suitable resin 257. Contacts 251 and 253 provide electrical current to the trough. Alternatively the troughs can be made of anodized aluminum wrapped with NICHROME ribbon. Anodized aluminum has the properties of good heat transfer and resistance to salt water corrosion.

First, second, and third embodiment troughs may be used with any embodiment heated line cutter and whipper.

Figure 12:
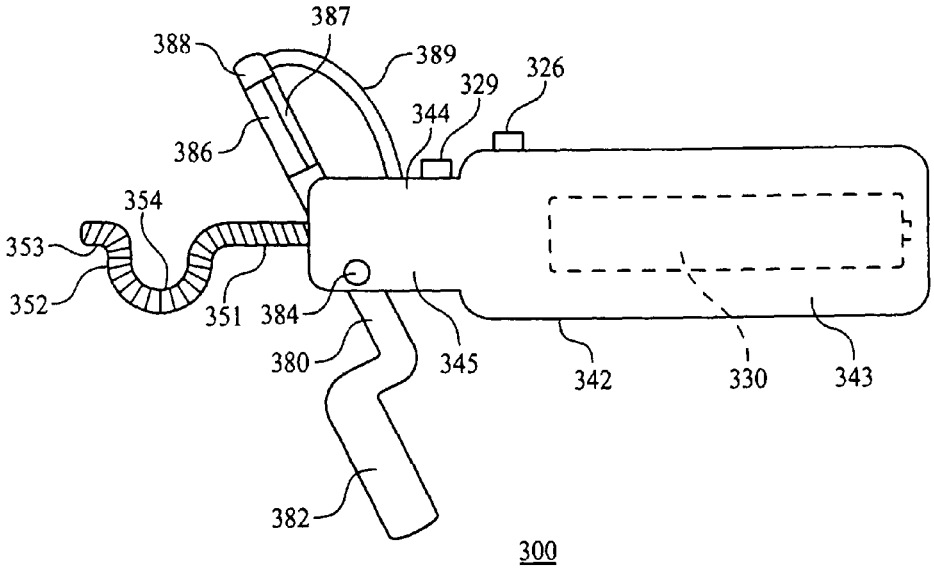
FIG. 12 is a plan view of the third embodiment heated line cutter and whipper.

FIG. 12 is a plan view of a third embodiment heated line cutter and whipper 300. Visible in FIG. 12 is the handle 342 comprised of a handle base 343 and a trough support 344. Also visible in FIG. 12 are one or more rechargeable batteries 330, an off/on indicator light 329 and a normally-off spring switch 326 which controls the heating of the trough. Normally-off spring switch 327, not visible in FIG. 12, controls the heating of the knife. The trough support 344 is split by the knife slot 348 (shown in FIG. 13) forming left arm 345 and right arm 347 of the trough support 344. The trough in the third embodiment is a U-shaped structure 352 which is bent upward forming a rest for the cord being cut. In particular, the left leg 351 of the trough is shown mounted on the end of the left arm 345 of the trough support 344. The right leg 355 of the trough is shown mounted on the end or right arm 346 of the trough support 344. The trough is bent upward forming a rest 354 which retains a line to be cut. The trough 352 is wrapped by resistance ribbon 353 capable of resistance heating when in an electrical circuit. In some embodiments trough 352 is manufactured of anodized aluminum.

Also visible in FIG. 12 is a cutter arm 380, comprised of a cutter handle 382 and a blade support 388. A blade 386 extends along and is attached to the lower edge 387 of the blade support 388. The blade is comprised of material capable of resistance heating when in an electrical circuit. In other embodiments the blade is a single self-supporting piece of resistance ribbon without a blade support. The cutter arm 380 is pivotally connected to the trough support 344 by bolt 384, although one of ordinary skill would realize that any suitable pivotal connector can be used. A connector wire 389 provides electrical connection between the distal end of the blade and the handle 342.

Figure 13:
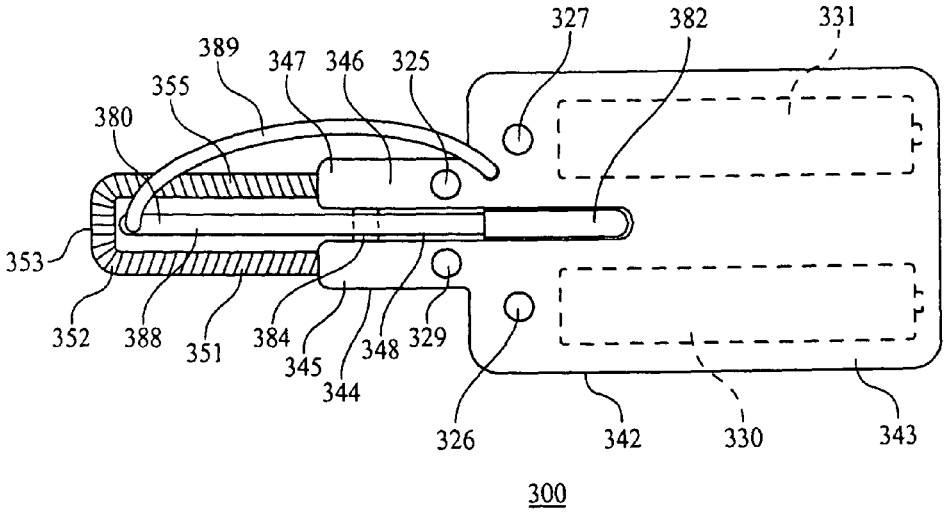
FIG. 13 is a dorsal view of the third embodiment heated line cutter and whipper.

FIG. 13 is a dorsal view of the third embodiment heated line cutter and whipper 300. Visible in FIG. 13 is the handle 342 comprised of a handle base 343 and a trough support 344. Also visible in FIG. 13 are one or more rechargeable batteries 330 and 331, an off/on indicator light 329 and a normally-off spring switch 326, also known as trough switch 326, which controls the heating of the trough. A second normally-off spring switch 327, also known as knife switch 327, controls the heating of the knife and has an off/on indicator light 325, located on the top 346 of the right arm 347. The trough in the third embodiment is a U-shaped structure 352 which is bent upward forming a rest for the cord being cut. The left leg 351 of the trough is mounted on the end of the left arm 345 of the trough support 344. The right leg 355 of the trough is mounted on the end of the right arm 347 of the trough support 344. The trough is wrapped by resistance ribbon 353 capable of resistance heating when in an electrical circuit. In embodiments trough 352 is manufactured of anodized aluminum.

Also visible in FIG. 13 is a cutter arm 380, comprised of a cutter handle 382 and a blade support 388. A blade 386 (not visible in FIG. 13) extends along and is removably attached to the lower edge of the blade support 388. The blade is comprised of material capable of resistance heating when in an electrical circuit. The blade is capable of replacement and in this embodiment is comprised of NICHROME ribbon. The cutter arm 380 is pivotally connected to the lower arm trough support 344 by bolt 384. The cutter arm 380 extends through the knife slot 348 between the left arm 345 and right arm 347 which comprise the trough support 344 of the handle 342. A connector wire 389 provides electrical connection between the distal end of the blade and the handle 342.

In use, a line to be cut and whipped is laid on the trough 352 with the blade 386 in the upper position above the line. Knife switch 327 is moved to the on position, heating the knife. The line is cut by the heated knife by moving the cutter handle 382 toward the handle 342. Heat-shrink tubing is then placed over the cut ends of the cord and the trough switch 326 is moved to the on position, causing the trough to heat and shrink the heat-shrink tubing. Alternatively, the heated trough can be used to whip the cut ends of the line by rotating the ends of the line against the heated trough surface, causing melting of the ends of the line.

Figure 14:
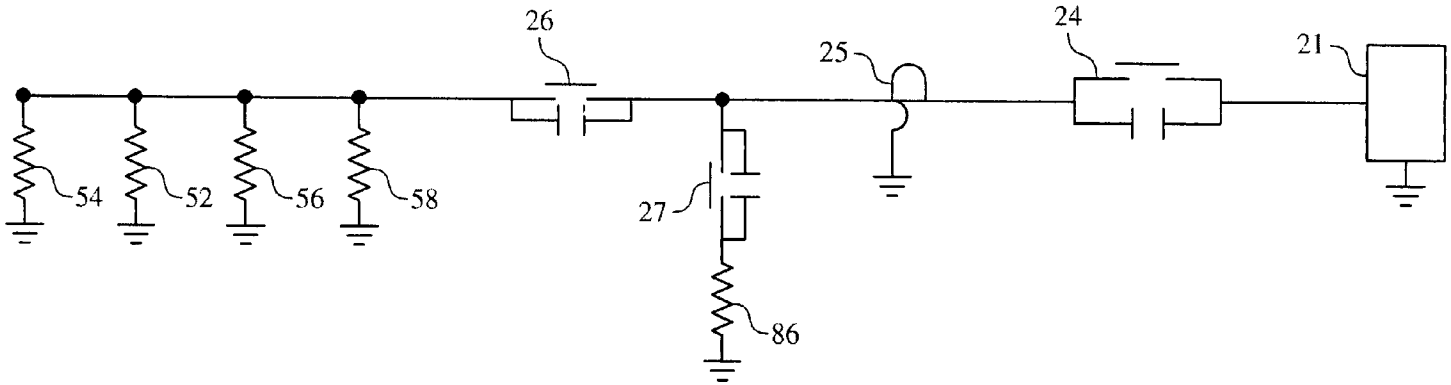
FIG. 14 is a schematic diagram of the wiring of the first embodiment heated line cutter and whipper.

FIG. 14 is a schematic diagram of the wiring of the first embodiment heated line cutter and whipper. Visible in FIG. 14 is the battery or batteries 21, main off/on switch 24, main indicator light 25, and normally-off spring switch 26 which controls current to the troughs. Also shown is the left lower trough 52, right lower trough 54, left upper trough 56, and right upper trough 58. When first embodiment troughs are used, only the left lower trough 52 and right lower trough 58 are included in the electrical circuits of FIG. 14. When the second and third embodiment troughs are used, all troughs shown in FIG. 14 are included in the circuits of FIG. 14. The normally-off spring switch 27 controls current to the knife blade 86.

Figure 15:
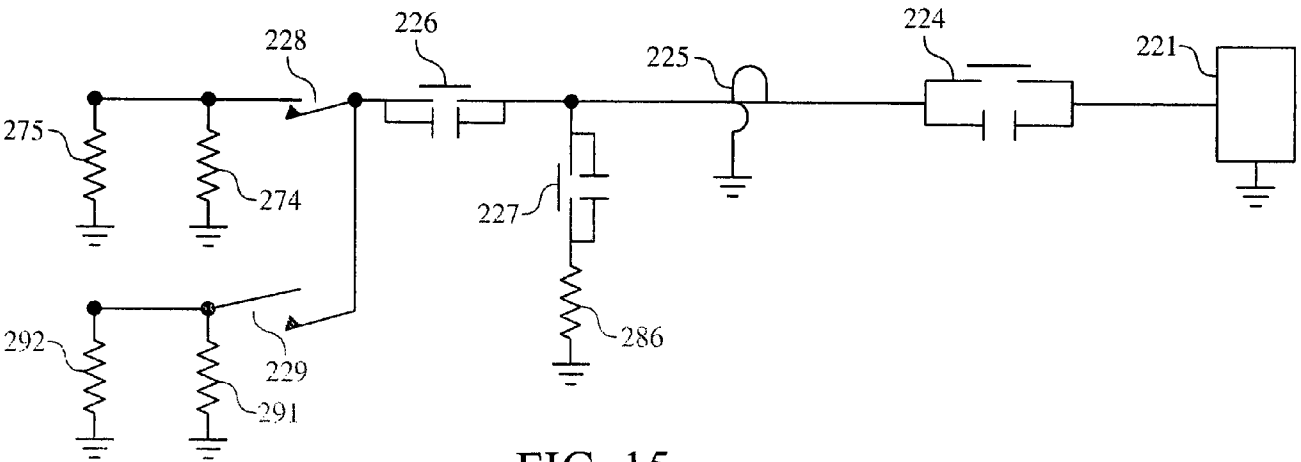
FIG. 15 is a schematic diagram of the wiring of the second embodiment heated line cutter and whipper.

FIG. 15 is a schematic diagram of the wiring of the second embodiment heated line cutter and whipper. Visible in FIG. 15 is the battery or batteries 221, main off/on switch 224, main indicator light 225, and normally-off trough spring switch 226. Also shown is the left upper 291, right upper 292, left lower 274, and right lower 275 troughs. Rotating contact 228 which directs current to those lower troughs which are in the cutting position and rotating contact 229 which directs current to those upper troughs which are in the cutting position are shown. Also shown is the normally-off spring switch 227 which controls current to the knife blade. 86.

Figure 16A:
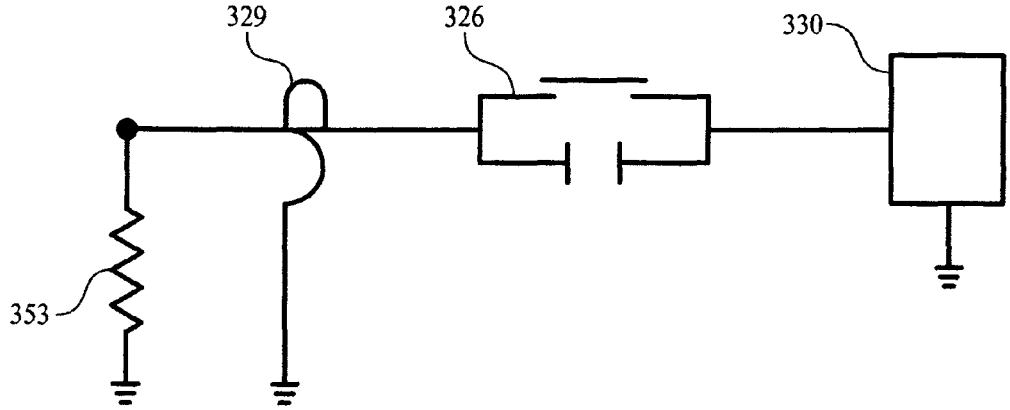
FIG. 16A is a schematic diagram of the wiring of the third embodiment heated line cutter and whipper showing the trough heating circuit.

FIG. 16A is a diagram of the trough heating circuit of the third embodiment heated line cutter and whipper. Visible in FIG. 16A is the battery or batteries 330, indicator light 329, and normally-off trough spring switch 326. Also shown is the trough 353.

Figure 16B:
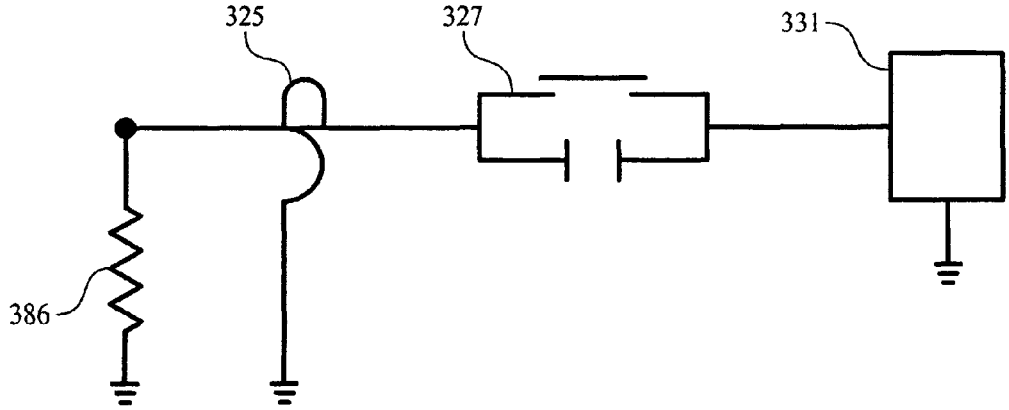
FIG. 16B is a schematic diagram of the wiring of the third embodiment heated line cutter and whipper showing the blade heating circuit.

FIG. 16B is a diagram of the blade heating circuit of the third embodiment heated line cutter and whipper. Visible in FIG. 16B is the battery or batteries 331, indicator light 325, and normally-off blade spring switch 327. Also shown is the blade 386.

In this disclosure the term "wire" is used to indicate an electrical conductor, which may be a conductive wire, cable, or a printed conductor, or a conductor on a board.

In the schematic diagrams of this disclosure lines indicate wires, connections between lines are indicated by a dot where the lines cross. Wires in the diagrams in the Figs. are shown and described as connected to the positive and negative poles of a battery. Other embodiments which are contemplated involve a reversal of the polarity of the wires in the embodiments.

In some embodiments the arms are manufactured of any suitable strong, electrically non-conductive and heat resistant material such as plastic, rubber, or wood. In one embodiment the arms are manufactured of polycarbonate plastic. In some embodiments the use of plastic resistant to temperatures of 1000° F. is contemplated.

In some embodiments the arms are manufactured of any suitable strong, electrically conductive material such as metals. In one embodiment the arms are manufactured of anodized aluminum. In embodiments in which the arms are manufactured of conductive materials, the trough and the blade are mounted with electrically insulating material between the troughs and the blade and the arms. Insulated wires are used to make the electrical circuits between troughs and blade and battery.

Any suitable strong electrical resistant metal, metal alloy, or other material subject to resistance heating when incorporated in an electrical circuit may be used for the troughs and blade. In some embodiments the troughs and blades are comprised of NICHROME resistance material.

The troughs are approximately hemispherical in cross-section. When the cutter is in the closed position a line is enclosed by troughs on all sides. The radius of the troughs approximates the radius of the line being cut and is chosen to include the radii of the lines most commonly being cut. Suitable radii include $4/32$ inch, $14/32$ inch, and $20/32$ inch, although other suitable radii are anticipated.

In this disclosure the term "wire" means insulated electrical wire or cable, as well as printed electrical conductors or bosses or other means for conducting electricity.

In operation of some embodiments a set of troughs which approximately correspond to the size of the line to be cut is selected and the appropriate trough switch is placed in the on position. The off/on switch is placed in the on position, and the line is grasped by the troughs. Movement of the cutter arm activates a normally-off spring switch and the knife is heated by the passage of electrical current from the battery through the knife. The cutter handle is then pressed causing the heated blade to sever the line. Release of the cutter handle causes the normally-off spring switch to return to the off position. A normally-off spring switch then is depressed by the operator causing heating of the troughs. The heated troughs melt the synthetic polymer fibers about the severed ends, thereby permanently preventing raveling of the cut ends. The line is then released and the normally-off spring switch is released to assume the off position, allowing the troughs to cool.

In some embodiments the operator directly controls the switch which activates the heating of the troughs and which activates the heating of the cutter blade.

Although this disclosure shows one or more batteries as power source, a variety of different power sources are contemplated. For example, any suitable battery of 6, 12, 14, and other volts direct current can be used. Either rechargeable or nonrechargable batteries can be used. A suitable cutter and whipper uses a rechargeable 12 volt battery. Use of a battery as power source has the desirable property of allowing safe and convenient use in the marine environment, and convenient use while outdoors and distant from a power line. Also contemplated is the use of a transformer in place of the battery to provide direct current of suitable voltage from the lines. Finally, embodiments are contemplated which use 110 volt alternating current from the lines.

The temperature of the knife and troughs can be regulated by controlling the voltage or the current in the electrical system or the length of the resistance material in the knife and in the troughs.

Table 1 shows the melting points of several materials commonly used in lines. The appropriate temperature for cutting the line of interest is used with the line cutter and whipper. Most commonly used lines are cut and whipped using a temperature for the knife and troughs of approximately 500° F.

TABLE 1

| Material | Melting Point ° F. |
|---|---|
| Nylon | 460 |
| Polyester | 480 |
| Para-aramid | 800 |
| Polypropylene | 330 |
| Polyethylene | 280 |
| High Molulus Polyethylene (HMPE) | 280 |
| Liquid Crystal Polymer. | 620 |
| Phenylene benzobisoxazole (PBO) | 1200 |
| Manila | 275 |

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope.

I claim:

1. A heated line cutter and whipper comprising:

a handle comprised of a base and a trough support extending from one end of the base, the trough support comprised of parallel left and right arms defining a slot between the arms, a U-shaped trough having two legs, one leg of the trough mounted on the left arm of the trough support and the other leg mounted on the right arm of the trough support, the trough bent upward forming a rest which retains a line to be cut, the trough capable of resistance heating by electrical current, a cutting arm having a handle and a blade mounted on the handle, the blade comprised of material capable of resistance heating by electrical current, the cutting arm mounted by a pivot to the trough support, the blade capable of passing through the slot between the arms of the trough support, the blade capable of passing between the trough legs thereby cutting a line resting on the trough, and at least one electrical source, wires, and at least one switch for controlling electrical current to the trough and blade.

2. The heated cutter and whipper of claim 1 wherein the electrical current to the trough and to the blade are controlled by separate circuits.

3. The heated cutter and whipper of claim 1 wherein the electrical current source is at least one battery, or is the line current.

4. The heated cutter and whipper of claim 1 wherein the handle is constructed of electrically non-conductive plastic, rubber or wood.

5. The heated cutter and whipper of claim 1 wherein the trough is comprised of metal rod wrapped by resistant material ribbon.

6. The heated cutter and whipper of claim 1 wherein the trough is comprised of anodized aluminum.

7. The heated cutter and whipper of claim 1 wherein the blade is comprised of nickel chromium resistant material ribbon.

8. The heated cutter and whipper of claim 1 wherein the blade is capable of replacement.

9. A heated line cutter comprising:

a handle comprised of a base and a trough support extending from one end of the base;

the trough support comprised of left and right arms defining a slot therebetween;

a trough having two legs, one leg mounted on the left arm of the trough support and the other leg mounted on the right arm of the trough support;

a cutting arm having a handle and a blade, the blade comprised of material capable of resistance heating when in an electrical circuit, the cutting arm mounted by a pivot to the trough support, the blade capable of passing through the slot and cutting a line resting on the trough, and at least one electrical source, wires, and at least one switch for controlling electrical current to the blade.

10. The heated line cutter of claim 9 wherein the trough is capable of resistance heating by electrical current.

11. The heated line cutter of claim 10 further comprising a second switch for controlling electrical current to the trough.

12. The heated line cutter of claim 9 wherein the electrical current to the trough and to the blade are controlled by separate circuits.

13. The heated line cutter of claim 9 wherein the electrical current source is at least one battery, or is the line current.

14. The heated line cutter of claim 9 wherein the handle is constructed of electrically non-conductive plastic, rubber or wood.

15. The heated line cutter of claim 9 wherein the trough is comprised of metal rod wrapped by resistant material ribbon.

16. The heated line cutter of claim 9 wherein the trough is comprised of anodized aluminum.

17. The heated line cutter of claim 9 wherein the blade is comprised of nickel chromium resistant material ribbon.

18. The heated line cutter of claim 9 wherein the blade is capable of replacement.

* * * * *